US007775489B2

(12) United States Patent
Facis et al.

(10) Patent No.: US 7,775,489 B2
(45) Date of Patent: Aug. 17, 2010

(54) SUPPORT FOOT FOR CABINETS

(75) Inventors: Bruno Facis, Pordenone (IT); Renzo Tisiot, Pordenone (IT)

(73) Assignee: Promark S.p.A., Pordenone (IT)

( * ) Notice: Subject to any disclaimer, the term of this patent is extended or adjusted under 35 U.S.C. 154(b) by 83 days.

(21) Appl. No.: 12/226,210

(22) PCT Filed: Mar. 26, 2007

(86) PCT No.: PCT/EP2007/052872

§ 371 (c)(1),
(2), (4) Date: Oct. 10, 2008

(87) PCT Pub. No.: WO2007/122057

PCT Pub. Date: Nov. 1, 2007

(65) Prior Publication Data

US 2009/0160301 A1 Jun. 25, 2009

(30) Foreign Application Priority Data

Apr. 20, 2006 (IT) ..... PN20060015 U

(51) Int. Cl.
*A47B 91/00* (2006.01)
*F16M 11/20* (2006.01)

(52) U.S. Cl. ..... 248/188.8; 248/188.2; 248/188.4

(58) Field of Classification Search ..... 248/188.8, 248/188.2, 188.4, 188.5, 188.3, 615
See application file for complete search history.

(56) References Cited

U.S. PATENT DOCUMENTS 5,697,586 A * 12/1997 Lybarger ..... 248/188.4
7,442,161 B2 * 10/2008 Gainer ..... 353/70
7,556,227 B2 * 7/2009 Thuelig ..... 248/188.8
2005/0218276 A1 10/2005 Inoue

FOREIGN PATENT DOCUMENTS

| | | |
|---|---|---|
| AU | 572980 | 5/1988 |
| FR | 2 461 880 | 2/1981 |
| WO | 2004/104471 | 12/2004 |

OTHER PUBLICATIONS

International Search Report mailed Mar. 28, 2008 for International Application No. PCT/EP2007/052872.
Written Opinion of the International Searching Authority mailed Mar. 28, 2008 for International Application No. PCT/EP2007/052872.

* cited by examiner

*Primary Examiner*—Amy J Sterling
(74) *Attorney, Agent, or Firm*—Wenderoth, Lind & Ponack, L.L.P.

(57) ABSTRACT

The present invention refers to a support foot for cabinets, in particular outer casings of home electric appliances.

The support foot (1) according to the present invention comprises a bush (3) provided with at least one lug (4) for said bush (3) to be able to be clamped and fastened within an aperture (5) provided in the bottom wall (2) of a cabinet; the foot (1) further comprises a resting member (9) associated to the bush (3), and is characterized in that said at least one lug (4) comprises one or more serrations or teeth (8) adapted to cooperate with at least a protrusion (6) provided on said bottom wall (2) in proximity of said aperture (5).

17 Claims, 2 Drawing Sheets

SUPPORT FOOT FOR CABINETS

The present invention refers to a support foot for cabinets, in particular outer casings of home electric appliances Cabinets of the most varied kind, as they are used throughout the home nowadays, are generally provided with two or more support feet that usually comprise a bush attached on to the bottom wall of the related cabinet, as well as a resting member screwed on to said bush, which is provided to come into contact with and rest on the floor. Support feet of this kind are generally adjustable in the height thereof, i.e. vertically, and enable the cabinet to rest on the floor in a most stable manner. In other words, by screwing the resting member in or out relative to the bush, the height of the support foot can be adjusted as needed or desired, so as to compensate for any possibly existing irregularity of the floor, which the cabinet is due to rest upon. This is a particularly useful feature in the case of cabinets forming the outer casing of home electrical appliances in general.

A support foot of this kind is for example disclosed in the French Utility Model application no. FR 2 461 880. The adjustable support foot described in the cited publication is provided with a resting member that screws on into a bush, which is attached to the bottom wall of the outer casing of a home electrical appliance by means of a plurality of lugs provided in two parallel planes in a mutually offset, i.e. staggered arrangement. By inserting the bush in an appropriately shaped aperture provided in the bottom wall of the casing, and then rotating the same bush therewithin, the lugs interact with the wall, thereby providing a bayonet-like kind of coupling. For the bush to be able to be kept stably in position, one of the lugs is provided with a greater length, i.e. is longer than the other ones, and comprises a dowel that sinks into a corresponding aperture that is appropriately provided in the bottom wall of the casing.

A major drawback of the adjustable foot disclosed in FR 2 461 880 lies in the fact that the bush can only be fitted in the aperture provided in the bottom wall of the casing or cabinet in an acceptably convenient manner if this is done from the inside of the casing or cabinet. This is due to a lug that is longer than the remaining ones being provided, so that fitting the bush in the corresponding aperture from the outside of the casing, or cabinet, turns out as being particularly awkward, if not impossible at all. It can be readily appreciated that such circumstance would make a possibly required replacement of the foot particularly inconvenient, time-consuming and, therefore, expensive to be carried out.

In addition, the bayonet-like kind of coupling that comes to exist between the lugs and the surface of the bottom wall of the casing might prove as not being effective to any satisfactory extent owing, for instance, to the manufacturing tolerances in the actual size of the foot and possible localized irregularities of said surface.

A further drawback of the above-described foot lies in the fact that the complexity of the manipulations that need to be carried out when fitting the bush in the aperture provided in the wall at the bottom of the outer casing of the home electrical appliance does practically not allow for any automated assembly of the appliance itself using automatic machinery to this purpose.

It is therefore a main object of the present invention to solve the above-noted problems and do away with the drawbacks of prior-art support feet.

Within this general object, it is a purpose of the present invention to provide a support foot that is easily and conveniently mounted on to the bottom wall of a cabinet, such as in particular the outer casing of a home electrical appliance, by working from the outside of the same cabinet or casing.

A further purpose of the present invention is to provide a support foot that can be attached in a stable manner to the bottom wall of a cabinet, or casing, wherein the same foot can then be most easily and conveniently removed and replaced in the case of a breakdown, and is further capable of being mounted with the use of automatic machinery.

According to the present invention, the above-noted object and aims are reached in a support foot that incorporates the features and characteristics as defined and recited in claim 1 appended hereto.

Features and advantages of the present invention will anyway be more readily understood from the description that is given below by way of non-limiting example with reference to the accompanying drawings, in which.

Figure 1:
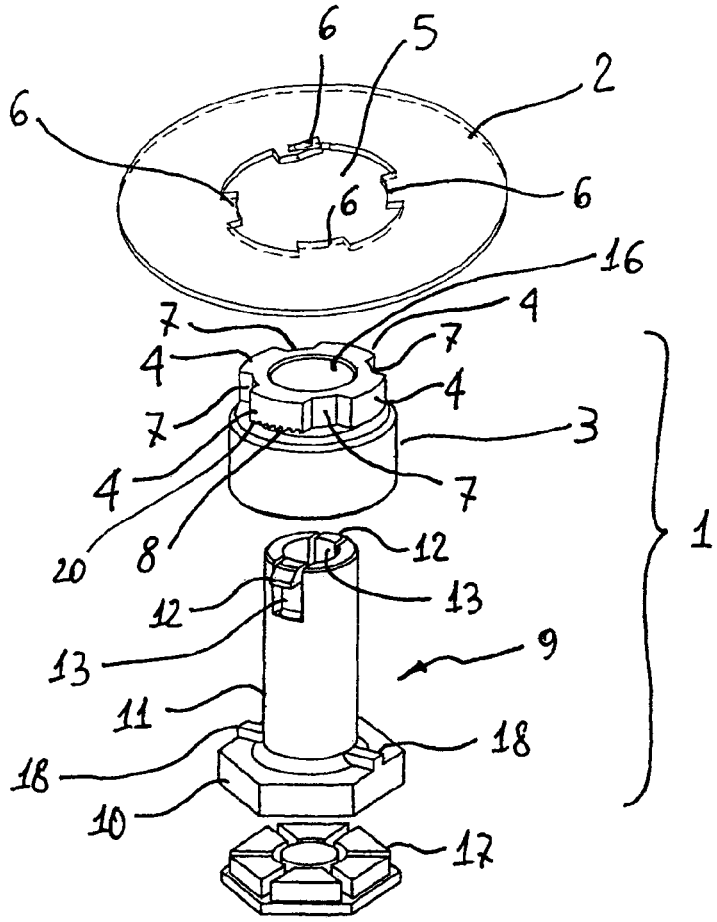
FIG. 1 is an exploded view of a support foot for cabinets and a portion of the bottom wall of a cabinet.
Figure 2:
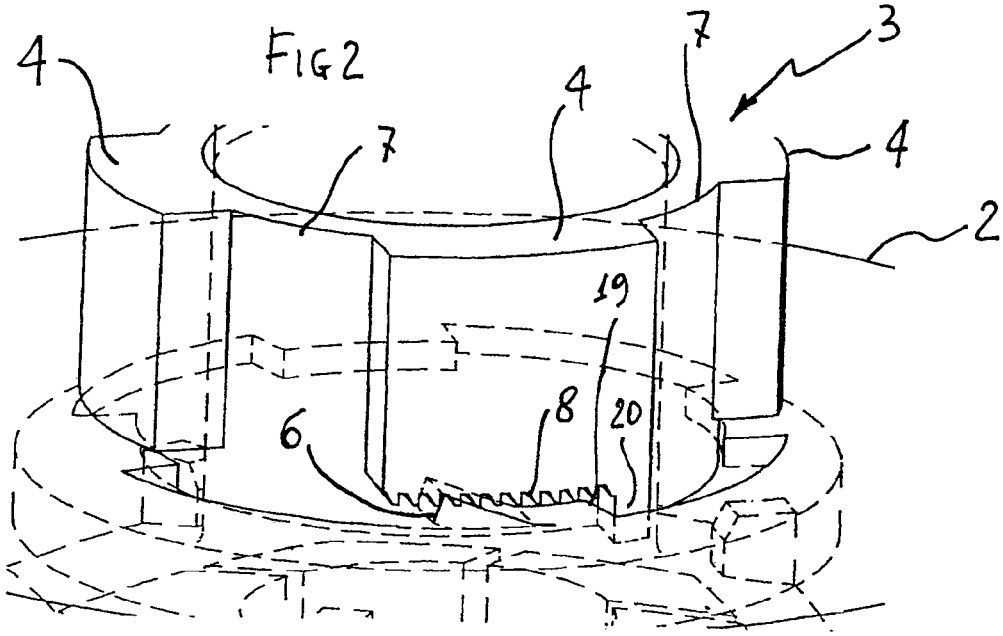
FIG. 2 is a perspective view of the attachment of the support foot on to the bottom wall of a cabinet.

Illustrated in FIG. 1 is a support foot 1 adapted to be fitted in and attached to a bottom wall 2 of a cabinet, as may be represented by the outer casing of a home electrical appliance. The foot 1 comprises a bush 3 provided with lugs 4 separated from each other by gaps or recessed portions 7 that are instrumental to fastening the bush 3 on to the wall 2. Provided in such wall 2 there are an aperture 5 and a plurality of protrusions 6 that are so sized and shaped as to be able to be received within the gaps or recessed portions 7 of the bush 3 when the latter is fitted in the aperture 5. At least one of these protrusions 6 is bent into forming a kind of pawl or hook-like configuration adapted to engage with one or more of the teeth 8 provided on one or more of the lugs 4, so as this is best shown in FIG. 2. The teeth 8 preferably have a slanting, i.e. ratchet, configuration so as to allow the bush 3 to rotate relative to the wall 2 in one direction only, while preventing it from rotating in the opposite direction. The extent by which the bush 3 is able to rotate relative to the wall 2 is limited by an abutment member 20 provided on the lugs 4 themselves.

In view of increasing the firmness, i.e. stableness of the attachment of the bush 3 to the wall 2, more lugs than just a single one may be provided with teeth 8, while more protrusions than just a single one may be bent into forming a pawl-like configuration, accordingly. Preferably, two or more lugs 4 are provided with one or more teeth 8 and all of the protrusions 6 are bent into forming a plurality of pawls. According to this embodiment, wherever the protrusions 6 bent into a pawl-like configuration come into contact with a lug 4 that is not provided with teeth 8, the capability of the bush to ensure a good grip, i.e. hold firmly against the bottom wall 2, and in particular to resist unscrewing, is ensured by the friction generated by the interference created between the bent protrusion 6 and the same lug 4.

Figure 3:
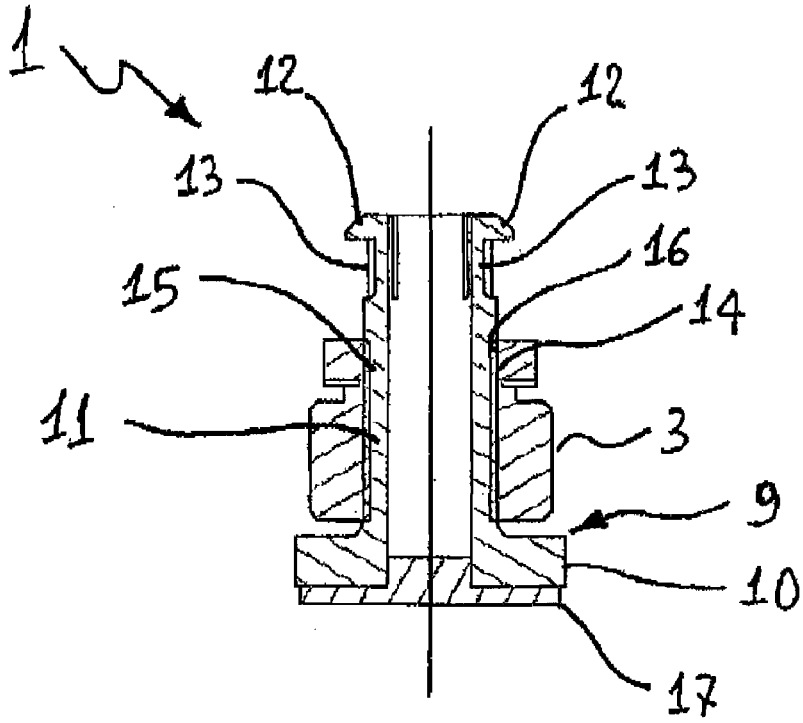
FIG. 3 is a longitudinal cross-sectional view of the support foot shown in FIG. 2, as viewed in the assembled state thereof.

The support foot 1 further comprises a resting member 9 provided with a head 10, which is arranged to be brought into contact with the floor, and a stem 11. Provided on such stem there are a plurality of juts 12, which are preferably formed on elastically deformable flaps 13 provided in an end portion of the stem 11. The outer surface of the stem 11 is provided with threads 14 adapted to rotatably mesh and engage with conjugated threads 15 provided on the bush 3 (FIG. 3). In this manner, the position of the resting member 9 relative to the bush 3 attached to the wall 2 can be changed by varying the vertical extension of the foot 1. For the friction between the two set of threads 14, 15 to be increased, a protrusion 16 may be provided on the conjugated threading 15 (lead screw) of the bush 3.

For the foot 1 to be mounted on to the bottom wall 2 of the cabinet, or casing, it will be necessary for the bush 3 to be inserted in the aperture 5 provided in the wall 2, in such a manner that the protrusions 6 are enabled to fit into the recesses 7. Then, for the bush 3 to be locked in place in the wall 2, all it takes is rotating the bush 3 relative to the wall 2 so that one or more protrusions 6 are enabled to cooperate with the teeth 8 provided on the lugs 4. Only the stem 11 of the resting member 9 will be able to be screwed into the bush 3.

The juts 12 act as stop or abutment means limiting the travel of the resting member 9, so as to prevent it from disengaging, i.e. coming off the bush 3 when the user decides to adjust the foot 1 in view of increasing the height, i.e. the vertical extension thereof.

When the stem 11 is inserted in the bush 3, the elastic flaps 13 bend towards each other to then extend and spring back into their original position when the stem 11, as duly screwed into and through the bush 3, comes out of the same bush 3. At this point, it will no longer be possible to disengage the resting member 9 from bush 3 if the juts 3 are not first duly acted upon.

The resting member 9 comprises one or more spacer members 18 that are provided to prevent the bush 3 from being able to damage the resting member 9 when the stem 11 is completely screwed down into the bush 3.

An insert 17 of a suitable nonslip material, such as for instance rubber, may be associated to the resting member 9, in particular onto the head 10 thereof. This insert 17 may be fitted in directly when manufacturing the foot 1, e.g. by having it overinjected, i.e. overmoulded thereupon.

Figure 4:
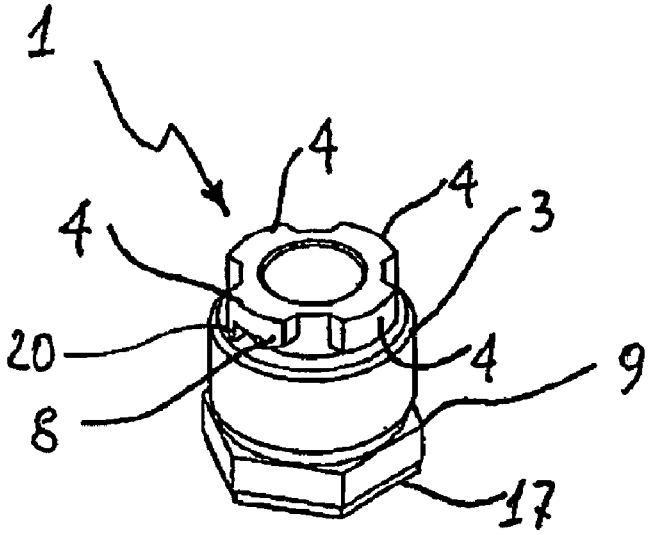
FIG. 4 is a perspective view of the support foot shown in FIG. 2, in a modified embodiment thereof.

A modified embodiment of the foot 1 is illustrated in FIG. 4. In this case, the bush 3 and the resting member 9 are made integrally as a single-piece, unitary construction and the foot is not adjustable in its height. One or more lugs 4 are provided with a tooth 8, which—as already described hereinbefore—is arranged to cooperate with one of the protrusions 6 provided in the bottom wall 2 of a cabinet, or casing, so as to enable the foot to be locked in place in the wall. The lugs 4 themselves may of course be provided with more than just a single tooth 8, in the same way as this has already been described hereinbefore with reference to FIGS. 1 and 2. The lugs 4 are further provided with an abutment or limiting member 20 as a stop means to prevent the bush 3 from rotating any further relative to the wall 2 as the foot is being mounted.

When the foot needs or has to be removed from the bottom wall 2 of the cabinet, or casing, for any of a number of possible reasons, it will be necessary for the bush 3 to be forced into rotating so that an end portion 19 of each protrusion 6 is capable of slashing the abutment member 20 provided on the slugs 4. At this point, the bush 3 will be able to be pulled out of the aperture 5 and the foot 1 removed and replaced.

Fully apparent from the above description is therefore the ability of the invention reach the afore-stated aims by providing a support feet for cabinets or the like, which is simple to both mount and remove for replacement in the case of a breakdown. Fully apparent is also the fact that the support foot according to the present invention is capable of being stably and fixedly attached to a bottom wall of a cabinet, such as the outer casing of a home electrical appliance, so as to make it impossible for it to come off accidentally or undesirably.

The support foot according to the present invention—further to cabinets in the most general sense—may be used for application to a plurality of home appliances, such as for instance laundry care appliances, food cooking appliances, food storage appliances, and the like.

It will be readily appreciated that the support foot according to the present invention, along with the various component parts thereof, may be subject to a number of modifications, and may be embodied in a number of manners differing from the exemplary ones described above, without departing from the scope of the present invention. It will furthermore be appreciated that all details as described hereinbefore may be replaced by technically equivalent elements, wherein the materials used for these elements and the sizing thereof may be appropriately selected each time in accordance with the actual needs or to comply with particular requirements.

The invention claimed is:

1. A support foot for cabinets, such as outer casings of home electric appliances, provided with a bottom wall having an aperture, said support foot comprising:

a bush provided with at least one lug for clamping and fastening said bush within the aperture; and a resting member connected to said bush, wherein said at least one lug comprises one or more serrations or teeth cooperating with at least a protrusion provided on the bottom wall in proximity of the aperture, and wherein said resting member comprises a stem having a plurality of juts, said juts being formed on elastically deformable flaps provided in an end portion of said stem.

2. The support foot according to claim 1, wherein said resting member comprises a head.

3. The support foot according to claim 1, wherein said resting member comprises one or more spacer members.

4. The support foot according to claim 1, wherein said resting member comprises threads adapted to rotatably engage with conjugated threads provided on said bush.

5. The support foot according to claim 4, wherein said conjugated threading is provided with a bulge or protrusion.

6. The support foot according to claim 1, wherein said bush and said resting member are made integrally as a single piece in a unitary construction.

7. The support foot according to claim 1, wherein said resting member is provided with an insert of a nonslid material.

8. The support foot according to claim 7, wherein said insert is removably associated to or overinjected upon said resting member.

9. The support foot according to claim 1, wherein said teeth have a ratchet configuration so as to allow said bush to rotate relative to the wall in one direction only, while preventing it from rotating in the opposite direction.

10. The support foot according to claim 2, wherein said resting member comprises one or more spacer members.

11. The support foot according to claim 1, wherein said resting member comprises one or more spacer members.

12. The support foot according to claim 2, wherein said resting member comprises threads adapted to rotatably engage with conjugated threads provided on said bush.

13. The support foot according to claim 1, wherein said resting member comprises threads adapted to rotatably engage with conjugated threads provided on said bush.

14. The support foot according to claim 3, wherein said resting member comprises threads adapted to rotatably engage with conjugated threads provided on said bush.

15. The support foot according to claim 2, wherein said bush and said resting member are made integrally as a single piece in a unitary construction.

16. The support foot according to claim 3, wherein said bush and said resting member are made integrally as a single piece in a unitary construction.

17. The support foot according to claim 2, wherein said resting member is provided with an insert of a nonslid material.

* * * * *